United States Patent [19]

Archer

[11] Patent Number: 4,550,759

[45] Date of Patent: Nov. 5, 1985

[54] APPARATUS FOR SIMULTANEOUSLY CLOSING AND OPENING A GROUP OF BLINDS

[75] Inventor: John Archer, Nynäshamn, Sweden

[73] Assignee: Ambient Energy Design, Nynäshamn, Sweden

[21] Appl. No.: 495,276

[22] Filed: May 16, 1983

[30] Foreign Application Priority Data

May 20, 1982 [SE] Sweden ..... 8203173

[51] Int. Cl.[4] ..... E06B 9/26

[52] U.S. Cl. ..... 160/176 R; 160/7; 160/DIG. 17

[58] Field of Search ..... 160/1-10, 160/107, DIG. 17, 176 R

[56] References Cited

U.S. PATENT DOCUMENTS

| | | | |
|---|---|---|---|
| 2,709,220 | 5/1955 | Spector | 343/903 |
| 3,646,985 | 3/1972 | Klann | 160/3 X |
| 3,675,023 | 7/1972 | Kunke et al. | 160/6 X |
| 4,096,903 | 6/1978 | Ringle | 160/107 |
| 4,173,721 | 11/1979 | Louis | 160/2 X |

*Primary Examiner*—Ramon S. Britts
*Assistant Examiner*—Cherney S. Lieberman
*Attorney, Agent, or Firm*—Pollock, Vande Sande and Priddy

[57] ABSTRACT

In a group of blinds each blind consists of a number of thin slats suspended from a horizontal shaft. The slats are attached to cords fixed to the shaft and the slats are turnably adjustable by rotating the shaft, which is connected to both a hand-operated mechanism and automatic drive unit. Said automatic drive unit is provided with a torque limiting device. Moreover, a timing device is connected to said drive unit for all blinds in the group for automatic actuation of all said drive units at determined points of time and setting of the slats in all blinds to closed or open position irrespective of their existing position set by said hand-operated mechanism.

7 Claims, 7 Drawing Figures

APPARATUS FOR SIMULTANEOUSLY CLOSING AND OPENING A GROUP OF BLINDS

The present invention relates to blinds for fitting inside double or triple glass windows or, if the windows are heremetically sealed, inside such sealed windows.

A conventional blind has two functions, namely to block sunlight and to inhibit viewing through the window for purpose of privacy. In recent years a so called heat insulating blind has also been constructed, which besides providing the foregoing functions also acts as an effective heat insulator in its closed position. Such a heat insulating blind is for instance described in Swedish Pat. No. 400 601.

The above mentioned and similar blinds are usually operated by a hand-operated mechanism, and in order to obtain a simple blind construction the slats are suspended by means of vertical cords from a horizontal axis of rotation arranged above the slats, for instance as shown in the above mentioned patent. It is also previously known to operate the turning of the slats and also their lowering and lifting by means of a motor provided with a gear box. This comparatively complicated drive mechanism can also be provided with a clutch that slips in case of a faulty operation or other trouble in order not to damage the slats. Moreover, it is previously known to operate simultaneously several blinds arranged in a straight row by means of a common rotation shaft for these blinds.

The object of the present invention is to be able, by means of driving means which are simple in construction, small in size, and operative to provide the torque for opening and closing the slats in each blind, to simultaneously at determined points of time set the slats in a group of individually hand-operated blinds to a closed or open position irrespectively of the existing position of the slats in each blind and without risk of damage to said drive means.

More particularly the invention relates to an apparatus for simultaneously closing and opening a group of blinds each consisting of a number of thin slats, which are suspended by means of vertical cords from at least one horizontal axis of rotation arranged above the slats, the slats upon rotation of said axis being adjustable via the vertical cords between a substantially horizontal open position and a substantially vertical closed position, said axis being connected to a hand-operated mechanism for individual adjustment of the slats in each blind, and the invention being characterized by the provision of driving means connected to said axis of each blind, said driving means being provided with means for limiting the torque exerted on said driving means when the position of the slats is adjusted by said hand-operated mechanism, and a timing device which starts and stops the operation of all said driving means in the group of blinds for automatic actuation of said driving means at determined points of time to set the slats in all blinds in the group to their closed or open position irrespective of the existing position to which they had previously been set by said hand-operated mechanism. The timing device may, for example, be an electric clock having contacts which can be adjustably set to those times when the blinds are to be opened or closed.

Thus, the present invention is a combination of blinds having hand-operated mechanisms and simultaneously operated automatic drive means. From a fully closed or open position the slats in all blinds can also by means of said drive means be adjusted to the same intermediate position by applying the necessary power to said drive means for a time interval required to reach the said intermediate position. Moreover, the slats of each blind can also be manually adjusted to any position as required by the existing weather conditions and individual requirement. The torque exerted on said drive means upon manual operation of the blinds can be considerably higher than the torque required for just opening and closing the slats by said drive means. Since, according to the invention, said drive means shall be simple in construction and adapted to provide said required torque, the aforementioned torque limiting means is arranged to protect said drive means from being damaged as a result of the comparatively higher torque that is exerted during manual operation of the blinds. Since furthermore each blind in the group is provided with an axis of rotation, a hand-operated mechanism and drive means, there is no limitation as to an arrangement in straight rows nor concerning the number of blinds in the group of blinds.

Other advantages obtained by the present invention will be evident from the following description and claims.

The invention will now be described more in detail with reference to the accompanying drawings, which schematically illustrate some embodiments of the invention.

Figure 1:
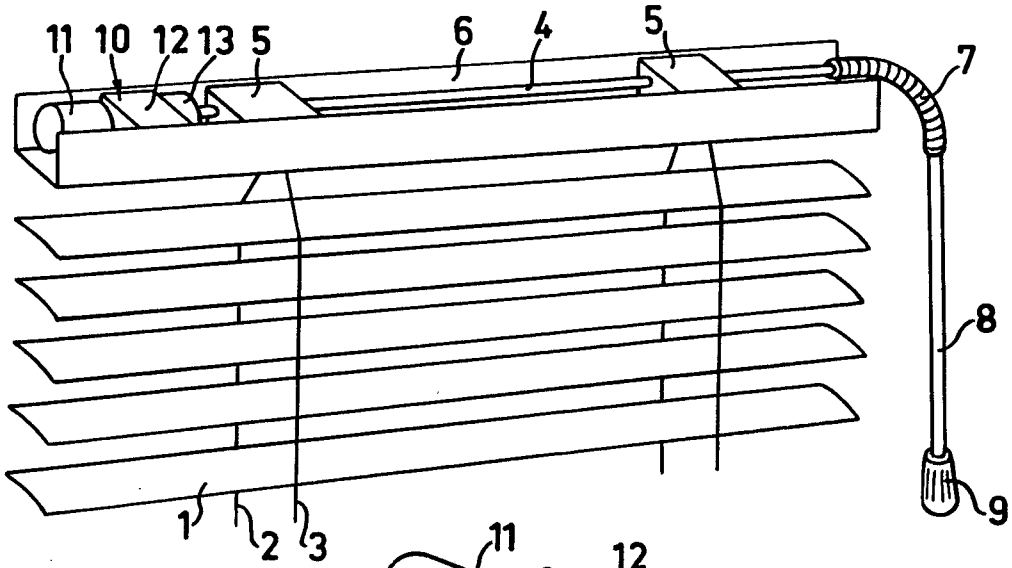
FIG. 1 is a perspective view showing the upper part of a blind according to one embodiment of the invention.
Figure 3:
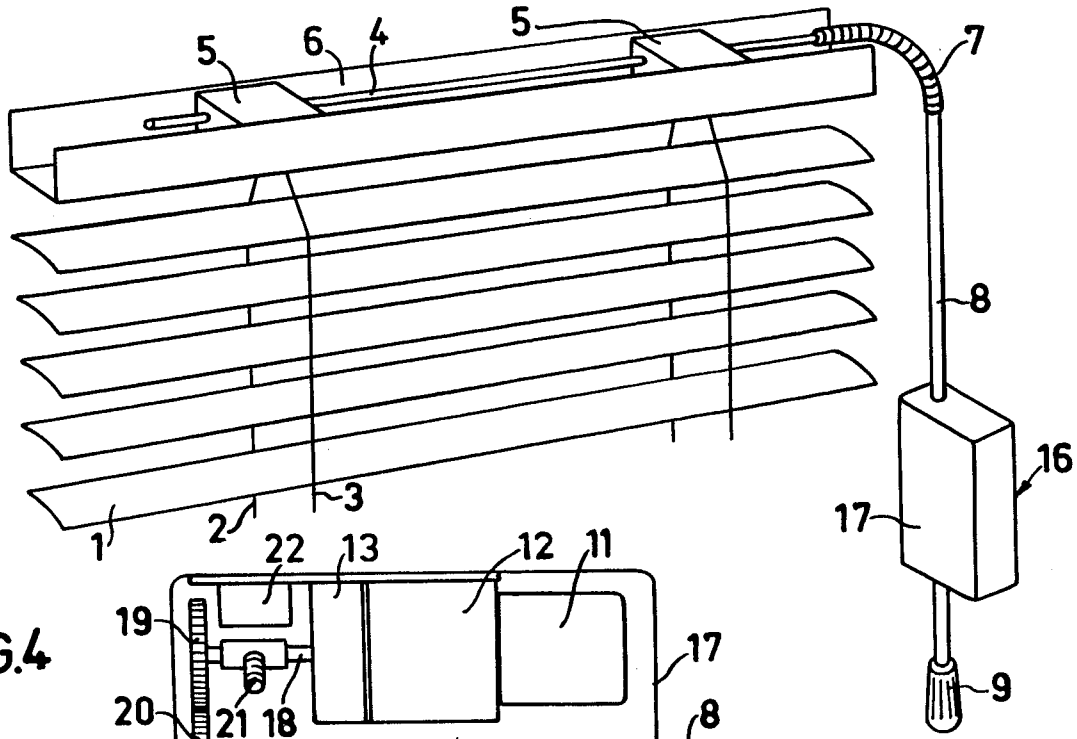
FIG. 3 is a perspective view of the upper part of a blind according to another embodiment of the invention.
Figure 4:
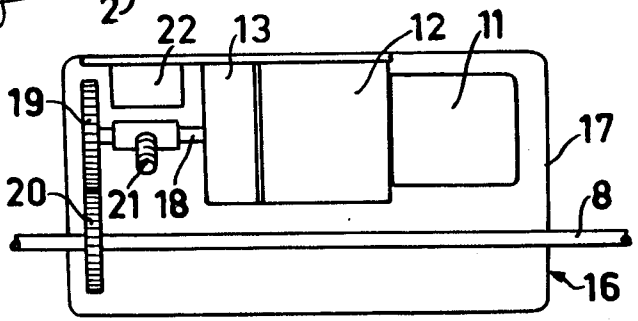
FIG. 4 is a section showing separately and in larger scale a driving unit for operation of the blind shown in FIG. 3.
Figure 6:
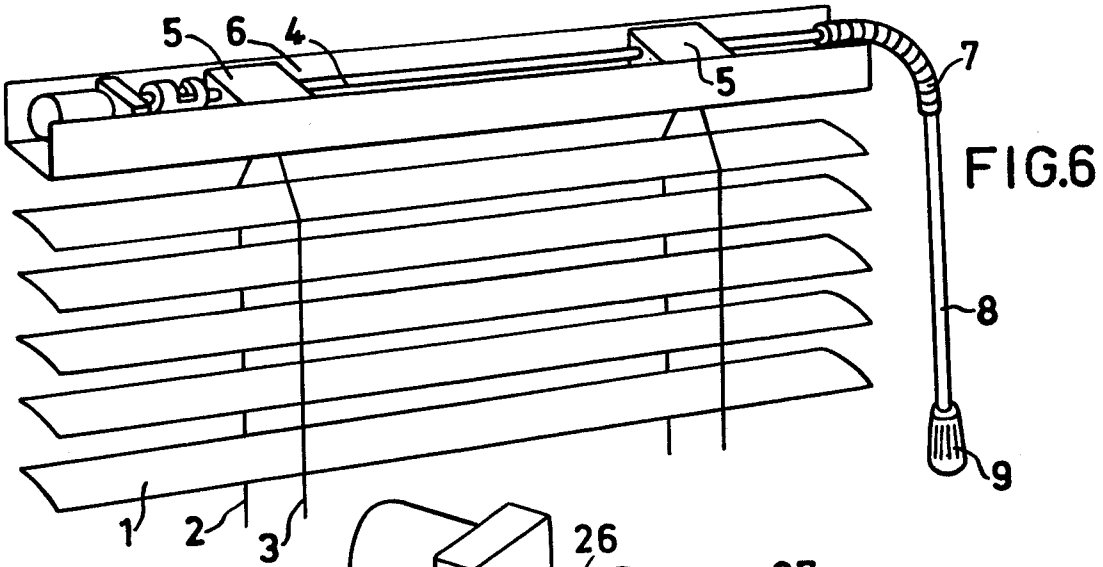
FIG. 6 is a perspective view showing the upper part of a blind according to a third embodiment of the invention.

As shown in FIGS. 1, 3 and 6, the blinds consist of thin slats 1 attached to the vertical cords 2 and 3, which are attached to a horizontal rotation shaft 4 journalled in bearings 5 arranged in a channel 6 above the slats.

Figure 2:
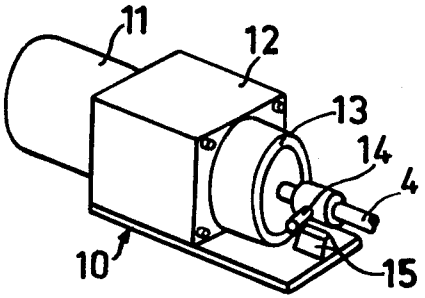
FIG. 2 is a perspective view showing separately and in larger scale a driving unit for operation of the blind shown in FIG. 1.

In the embodiment shown in FIG. 1 one end of the rotation shaft 4 is connected via a flexible shaft 7 and a bar 8 to a hand-operated mechanism 9 for manual rotation of the shaft 4 thereby to effect a turning movement of the slats 1 via the cords 2,3. The other end of the shaft 4 is directly connected to a drive unit 10 arranged in the channel 6. As best shown in FIG. 2, the drive unit consists of an electric motor 11, a gear box 12 and a slip clutch 13. The rotation of the shaft 4 upon the actuation of the drive unit 10 is limited by interaction between a pin 14 fixed to the shaft 4 and a fixed stop 15.

The embodiment shown in FIG. 3 differs from the embodiment of FIG. 1 particularly in that the drive unit, here designated with the reference numeral 16, is connected to the bar 8 between the flexible shaft 7 and the hand-operated mechanism 9. The drive unit 16 is enclosed in a casing 17 and, as shown in FIG. 3, consists also in this embodiment of an electric motor 11, a gear box 12 and a slip clutch 13. The output shaft 18 from the clutch 13 is provided with a gear 19 in engagement with a gear 20 on the bar 8. The rotation of the bar 8 is limited by interaction between a pin 21 fixed to the output shaft 18 and a stop 22 attached to the casing 17.

The required torque for opening and closing the slats in blinds of the kind schematically shown on the drawings, is about 4000 gram mm. This torque can be obtained by means of a small electric motor 11 and gear box 12. The torque exerted upon manual adjustment of the slats can easily exceed 8000 gram mm. This is a considerably larger torque than permitted for the gear box. If, accordingly, the motor and gear box should be directly coupled to the rotation shaft 4, there is an obvious risk of damage to the gear box when the slats are adjusted by the hand-operated mechanism 9. This risk is eliminated by the slip clutch 13, which limits the torque that is applied to the gear box when the slats are manually adjusted.

Figure 5:
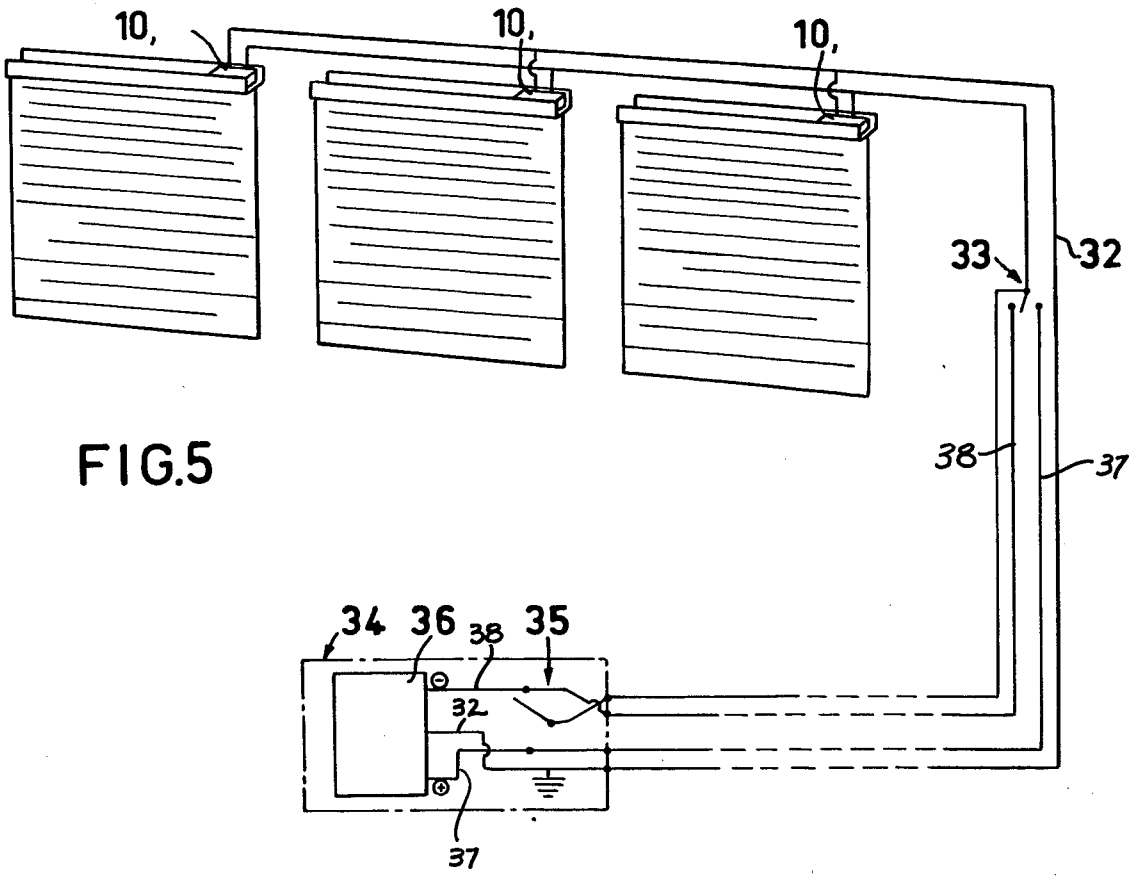
FIG. 5 illustrates a group of blinds, as exemplified three blinds, operated by a common timing unit.

FIG. 5 illustrates schematically the simultaneous automatic operation of a group of blinds, here exemplified three blinds. The drive units 10 or 16 are by electric cables 32 via a hand switch 33 connected to a central control box 34, which includes a switch 35 that is operated by a timing device (not shown) and a transformer and rectifier 36. The rectified output of transformer/-rectifier 36 comprises a DC voltage on a line 37 that is always positive to ground line 32 and a DC voltage on a line 38 that is always negative to ground line 32. A manually operable switch 33, and a timer operated switch 35, are disposed between lines 37 and 38 as illustrated. When the blinds are to be operated by hand, manually operable switch 33 is moved either to the left or right from its neutral central position so that it contacts either line 38 or line 37. The drive units 10 (or 16) are then energized with either a negative or positive voltage with respect to the ground line 32 and open or close the blinds. In a similar manner, timer operated switch 35 is moved from its neutral center position at time intervals determined by the timing device (not shown). When switch 35 moves upwards it contacts line 38, and when it moves downwards it contacts line 37. The drive units 10 (or 16) then either open or close the blinds.

When the blinds are to be automatically closed by means of the drive units 10 or 16, the existing setting of the slats in the separate blinds can be unknown since the blinds may have been manipulated individually and the slats accordingly manually set in different positions. It is presumed, that the therefore, blinds are all in fully open positions and that accordingly a maximum possible turning of the slats is required for closing them. Automatic closing is obtained by supplying voltage to the motors 11 for a sufficiently long time to insure a full closing from a fully open position. In cases when a blind is not fully open, the slats reach the fully closed position prior to the time the motor is shut off. Thus, the motor runs even after the blind is fully closed. However, the gear box 12 is prevented from being damaged by the operation of the slip clutch.

Thus, the above described torque limiting unit in the form of a slip clutch 13 protects gear box 12 when the hand mechanism 9 is used, protects the gearbox when a stop position is reached (fully closed on open blind position) and the motor still runs, and also allows the motor to run when a stop position is reached.

The automatic opening of the blinds normally takes place in the morning. In most cases the blinds have not been manually adjusted during the night. When the blinds are opened, they will start from the same fully closed position and the energization of all motors 11 for the same predetermined time interval ensures that all blinds will be opened to the same angle. The blinds can then be individually adjusted to desired positions by the hand-operated mechanism 9.

Figure 7:
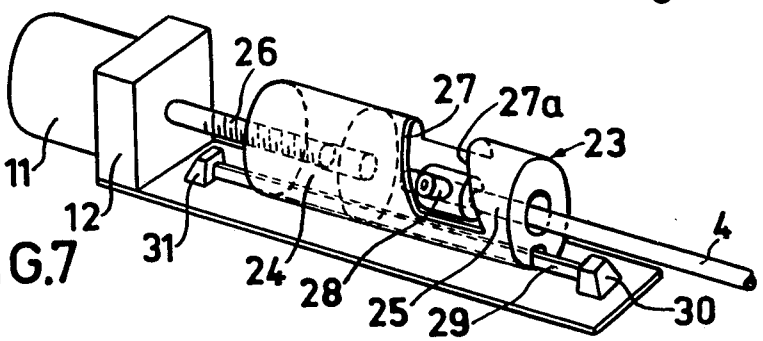
FIG. 7 is a perspective view showing separately and in larger scale a driving unit for the operation of the blind shown in FIG. 5.

Another embodiment of a torque limiting unit is shown in FIGS. 6 and 7. This unit, generally designated with the reference numeral 23, consists of a cylindrical cam unit, one end of which consists of a bar 24 and the other end of which consists of a hollow tube 25. The output shaft 26 from the gear box 12 is threaded into the bar 24 and the blind rotating shaft 4 is rotatably journalled in the tube 25. A recess is cut-out into the tube 25 two opposite guide surfaces 27 and **27*a*. These surfaces cooperate with a pin 28 fixed to the shaft 4. The cam unit 23 is prevented from rotation by a guide ledge 29 extending in the direction of the shaft 4 but cam unit 23 is allowed to move along the ledge 29 between two fixed stops 30 and 31**.

Upon actuation of the electric motor 11 the gear box 12 rotates the threaded output shaft 26 causing the cam unit 23 to move along the ledge 29. The direction of movement depends on the direction of the rotation of the shaft 26 and the movement in either one or the other direction is effected by the simple procedure of reversing the voltage supplied to the electric motor. The movement results in either guide surfaces 27, **27*a* coming into contact with the pin 28, and the cooperation between pin and guide surface causes the shaft 4 to rotate thereby opening or closing the slats 1. The stops 30 and 31** constitute positions at which the slats have reached the fully open or fully closed position.

The cam unit 23 may have an effective reduction ratio of 20:1, i.e. the threaded shaft 26 rotates twenty times for one rotation of the shaft 4 (in practice the shaft 4 only completes a part of one revolution) during travel of the cam unit 23 from stop 30 to stop 31. When the cam unit reaches a stop 30 or 31, the maximum torque exerted on the output shaft of the gear box 12 is limited to the stall torque of the motor 11 multiplied by the reduction ratio of the gear box. A maximum reduction ratio of 25:1 is necessary in this case. The torque resulting from the stall torque of the motor multiplied by the ratio of 25:1 is easily tolerated by the gearbox output shaft.

Without the cam unit 23 the total torque needed to operate the blind would be transmitted through the gear box 12 which would then necessarily have a reduction ratio of approx 500:1 ($25:1 \times 20:1$), i.e. the gear box would have to tolerate a torque twenty times larger. It would be practically impossible, or at best very difficult, to design a gear box to tolerate such a torque.

The cam unit 23 also ensures that when the hand-operated mechanism 9 is operated at the same time that the blind is being operated by the motor, the large torque from the hand-operation is not transmitted directly to the gear box 12 causing it to be damaged. Moreover, the cam unit can be returned to a central neutral position after each operation, in which neutral position the pin 28 is not in contact with either guide surface 27, **27*a***. In this position hand operation can occur without the pin contacting a guide surface and consequently without transmitting any torque to the gear box.

Although not shown, it is readily possible to automatically set all blinds into an intermediate position between the fully closed and open positions. This can be accomplished for instance by cam means or by applying power to the drive means for an appropriate time interval. Moreover, the invention can be varied in other ways within the scope of the following claims, for instance by providing other drive means and torque limiting means than those described above and shown on the drawings.

I claim:

1. An apparatus for simultaneously closing and opening a group of blinds each consisting of a number of thin slats which are suspended by means of vertical cords from at least one horizontal axis of rotation disposed above the slats, rotation of said axis being operable via the vertical cords to turnably adjust said slats between a substantially horizontal open position and a substantially vertical closed position, said axis being connected to a hand-operated mechanism for individual adjustment of the slats in each blind, an individual drive means for each of said blinds, each of said drive means being connected to said axis of rotation, each of said drive means being provided with means for limiting the torque exerted on said drive means when said hand-operated mechanism is operated to manually adjust the position of the slats, and a timing device connected to all of said drive means in the group of blinds for automatic energization of said drive means at predetermined points of time and for a preset time interval to set the slats in all blinds in the group to their closed or open positions irrespective of their then existing positions previously set by said hand-operated mechanisms.

2. An apparatus according to claim 1 wherein each of drive means consists of an electric motor provided with a gear box, said torque limiting means being arranged between the output axis of said gear box and said axis of rotation.

3. An apparatus according to claim 2 wherein said torque limiting means is a slip clutch.

4. An apparatus according to claim 2 wherein said torque limiting means consists of a pair of spaced guide surfaces, and a pin fixed to said axis of rotation and located between said guide surfaces, one of said guide surfaces being in contact with said pin when the slats are being opened and the other of said surfaces being in contact with the pin when the slats are being closed.

5. An operating apparatus comprising a blind having a plurality of elongated parallel slats each of which is connected, by cords extending transverse to said slats, to a rotatable rod disposed parallel to said slats, rotation of said rod being operable to move said cords thereby to effect pivotal motion of said slats between open and closed blind positions, manually operable means connected to said rod to rotate said rod thereby to open and close said blind manually, and driven means operative to rotate said rod automatically at predetermined times thereby to automatically open or close said blind at said predetermined times, said driven means comprising a drive unit and a timer for energizing said drive unit at said predetermined times, and for a preset time interval and means connecting said drive unit to said rod, said connecting means including means for limiting the torque which is exerted on said drive unit when said rod is rotated by said manually operable means.

6. The apparatus of claim 5 wherein said drive unit comprises an electric motor having a gearbox connected to its output shaft, said torque limiting means being disposed between said rotatable rod and said gearbox.

7. The apparatus of claim 6 wherein said torque limiting means comprises a slip clutch.

* * * * *